US005994853A

United States Patent [19]

Ribbe

[11] Patent Number: 5,994,853

[45] Date of Patent: Nov. 30, 1999

[54] SPEED CONTROL SYSTEM FOR A REMOTE-CONTROL VEHICLE

[75] Inventor: David J. Ribbe, Cincinnati, Ohio

[73] Assignee: Hasbro, Inc., Pawtucket, R.I.

[21] Appl. No.: 08/794,438

[22] Filed: Feb. 5, 1997

[51] Int. Cl.[6] ..... H02P 7/29

[52] U.S. Cl. ..... 318/16; 318/293; 388/829

[58] Field of Search ..... 318/16, 293, 139; 388/825, 828, 829

[56] References Cited

U.S. PATENT DOCUMENTS

| | | | |
|---|---|---|---|
| 4,349,986 | 9/1982 | Tsukuda | 46/254 |
| 4,749,927 | 6/1988 | Rodal et al. | 318/599 |
| 4,999,556 | 3/1991 | Masters | 318/599 |
| 5,043,640 | 8/1991 | Orton | 318/16 |
| 5,065,078 | 11/1991 | Nao et al. | 318/16 |
| 5,103,146 | 4/1992 | Hoffman | 318/16 |
| 5,136,452 | 8/1992 | Orton | 361/33 |
| 5,150,027 | 9/1992 | Suzuki | 318/581 |
| 5,216,337 | 6/1993 | Orton et al. | 318/16 |
| 5,218,276 | 6/1993 | Yeom et al. | 318/16 |
| 5,495,155 | 2/1996 | Juzswik et al. | 318/293 |
| 5,571,999 | 11/1996 | Harris | 200/565 |
| 5,577,154 | 11/1996 | Orton | 388/811 |

OTHER PUBLICATIONS

TX5/RX5 Remote Controller with Nine Functions, *Product Description*(Nov. 1994).

*Primary Examiner*—Bentsu Ro

*Attorney, Agent, or Firm*—Marshall, O'Toole, Gerstein, Murray & Borun

[57] ABSTRACT

A remote-control vehicle includes a controller that produces a pulse-width modulated (PWM) motor control signal and a forward/reverse motor control signal in response to a transmitted digital signal specifying one of a multiplicity of speed control states, each of which has a direction and a PWM duty cycle associated therewith. A MOSFET switch turns on and off in response to the PWM signal to control the flow of current between a battery and a motor to thereby control the speed of the motor. A relay, coupled between the battery and the motor, switches in response to the forward/reverse signal to change the direction of current flow through the motor to thereby control the direction of the motor.

23 Claims, 3 Drawing Sheets

SPEED CONTROL SYSTEM FOR A REMOTE-CONTROL VEHICLE

BACKGROUND OF THE INVENTION

The present invention relates generally to motor speed controllers and, more particularly, to speed controllers for remote-control toy vehicles.

DESCRIPTION OF RELATED ART

It is known to use pulse-width modulated (PWM) signals to control the flow of current through a motor in, for example, a remote-control vehicle, to thereby control the speed of the motor. For example, Nao et al., U.S. Pat. No. 5,065,078; Orton, U.S. Pat. No. 5,577,154; and Suzuki, U.S. Pat. No. 5,150,027 each discloses a remote-control device using a PWM signal to control the power provided to a motor. In these devices, the duty cycle of the PWM signal is increased to increase the speed of the motor and is decreased to decrease the speed of the motor. Typically, however, remote-control vehicles receive an analog control signal that must be demodulated and used to produce a PWM control signal of varying duty cycle. For example, the device of Nao et al. (U.S. Pat. No. 5,065,078) uses a stretched analog PWM signal developed from a received analog PWM control signal to generate a PWM motor control signal. Likewise, Suzuki (U.S. Pat. No. 5,150,027) develops an analog PWM signal from a received control signal, compares the PWM signal with a pulse signal generated by a one-shot circuit, and detects the difference between the widths of the two signals to determine the pulse width of a PWM motor control signal. Such analog decoding circuits require numerous components, which adds to the weight of the remote-control vehicle and reduces the life of a battery powering the vehicle.

Remote-control vehicles have also used elaborate circuits to effect forward and reverse motor functions. For example, Nao et al. (U.S. Pat. No. 5,065,078) develops a stretched analog PWM signal from a received analog PWM control signal, compares the stretched PWM signal with a pulse signal generated by a one-shot circuit, and detects the difference between the trailing edges of the two signals to determine the direction of a motor. Other prior art motor control circuits, such as those disclosed in Tsukuda, U.S. Pat. No. 4,349,986, and Juzswik et al., U.S. Pat. No. 5,495,155, use an H-bridge circuit, having semiconductor devices in the legs thereof, to drive a motor in both the forward and reverse directions. Typically, the semiconductor devices of such H-bridge circuits are operated to turn one leg of the bridge circuit off while turning the other leg on which changes the direction of current flow through the motor and, thereby, reverses the direction of the motor. However, H-bridge circuits typically require a relatively high amount of power to operate and develop voltage drops across the numerous semi-conductor devices connected in series with the motor, which reduces the amount of power supplied to the motor. These circuits also tend to increase the depletion of the battery which reduces the use time of the battery.

SUMMARY OF THE INVENTION

The present invention relates to a remote-control vehicle that provides a variable duty cycle PWM signal to a motor to vary the speed of the motor while simultaneously controlling the direction of the motor using simple, lightweight, and cost effective switching networks that do not have large voltage drops associated therewith.

In particular, a remote-control vehicle according to the present invention receives a digital signal specifying one of a multiplicity of speed control states, each of which has a direction and a PWM duty cycle associated therewith. A speed controller located on the vehicle decodes the received digital signal to identify the specified speed control state and produces a PWM signal and a forward/reverse signal in response thereto. The PWM signal, which controls the speed of a motor, is coupled to a switch, preferably comprising a semiconductor switch such as metal oxide semiconductor field effect transistor (MOSFET), and controls the flow of current between a power source, such as a battery, and the motor. The duty cycle of the PWM signal is varied from speed control state to speed control state to vary the speed of the motor. The forward/reverse signal controls the operation of a further switch coupled between the motor and the battery to change the direction of current flow through the motor. Preferably the further switch comprises a dual input, quadruple output relay, such as a double pole, double throw relay. In one embodiment, the relay has two sets of two outputs connected together such that each of the connected sets of outputs is coupled through one of the relay inputs to one of a set of motor terminals.

According to another aspect of the present invention, a speed control system for use in a remote-control vehicle includes a receiver that receives a digital control signal and produces a digital state signal specifying one of a multiplicity of speed control states and a speed controller responsive to the digital state signal that develops a forward/reverse signal and a PWM speed signal based on the specified one of the multiplicity of speed control states. A first switch is coupled between a power source and a motor and is responsive to the PWM signal for delivering a power signal from the power source to the motor. A second switch is coupled between the power source and the motor and is responsive to the forward/reverse signal to control the direction of the motor. Preferably, the receiver produces a digital state signal specifying one of at least six speed control states, three of which are forward states and two of which are reverse states.

The speed control system of the present invention may include circuitry for producing a ramped duty cycle PWM signal, varying between three or more different duty cycles over a first period of time, in response to a change between two non-consecutive speed control states in a second period of time that is less than the first period of time. The speed control system may also include a switch that prevents the use of one of the speed control states when in a first position and that allows the use of the one of the speed control states when in a second position.

According to another aspect of the present invention, a remote-control vehicle includes a transmitter module having a speed position sensing device that detects one of a multiplicity of speed positions and a digital signal transmitter coupled to the speed position sensing device that produces a digital control signal indicating one of a multiplicity of speed control states corresponding to the detected one of the multiplicity of speed positions. The remote-control vehicle also includes a vehicle having a receiver that receives the digital control signal and produces a digital state signal specifying the one of the multiplicity of speed control states. A speed controller on the vehicle develops a forward/reverse signal and a PWM speed signal based on the one of the multiplicity of speed control states specified by the digital state signal. A first switch is responsive to the PWM signal for delivering a power signal to a motor on the vehicle and a second switch is coupled to the motor and is responsive to the forward/reverse signal to control the direction of the motor.

DESCRIPTION OF THE PREFERRED EMBODIMENTS

Figure 1:
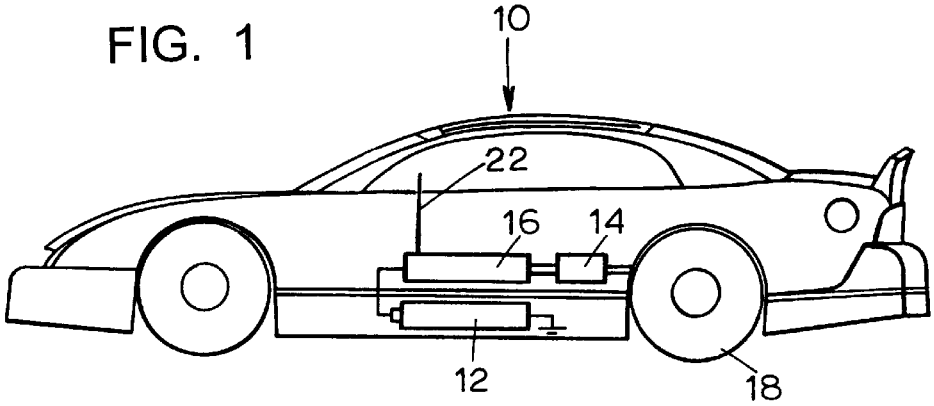
FIG. 1 is a side view of a toy vehicle having a speed control system according to the present invention.

Referring now to FIG. 1, a remote-control toy vehicle 10, illustrated as a toy car, includes a battery 12 electrically coupled to a motor 14 through a speed control system 16. When energized, the motor 14 actuates a drive mechanism, preferably comprising a differential drive mechanism, to cause rotation of one or more wheels 18 which, in turn, causes the vehicle 10 to move. The drive mechanism may be coupled between the motor 14 and the wheels 18 to drive the wheels 18 in any known or standard manner.

An antenna 22 receives a digital speed control signal from an operator-controlled transmitter unit 26 (FIG. 2) and delivers this signal to the speed control system 16. The speed control system 16 decodes the received signal to identify which one of a multiplicity of possible speed control states, each having a direction and a PWM duty cycle associated therewith, is being requested by the operator. The speed control system 16 then produces a PWM signal and a forward/reverse signal in response to the identified speed control state and uses these signals to control the connection between the battery 12 and the motor 14 to thereby control the speed and direction of the motor 14.

Figure 2:
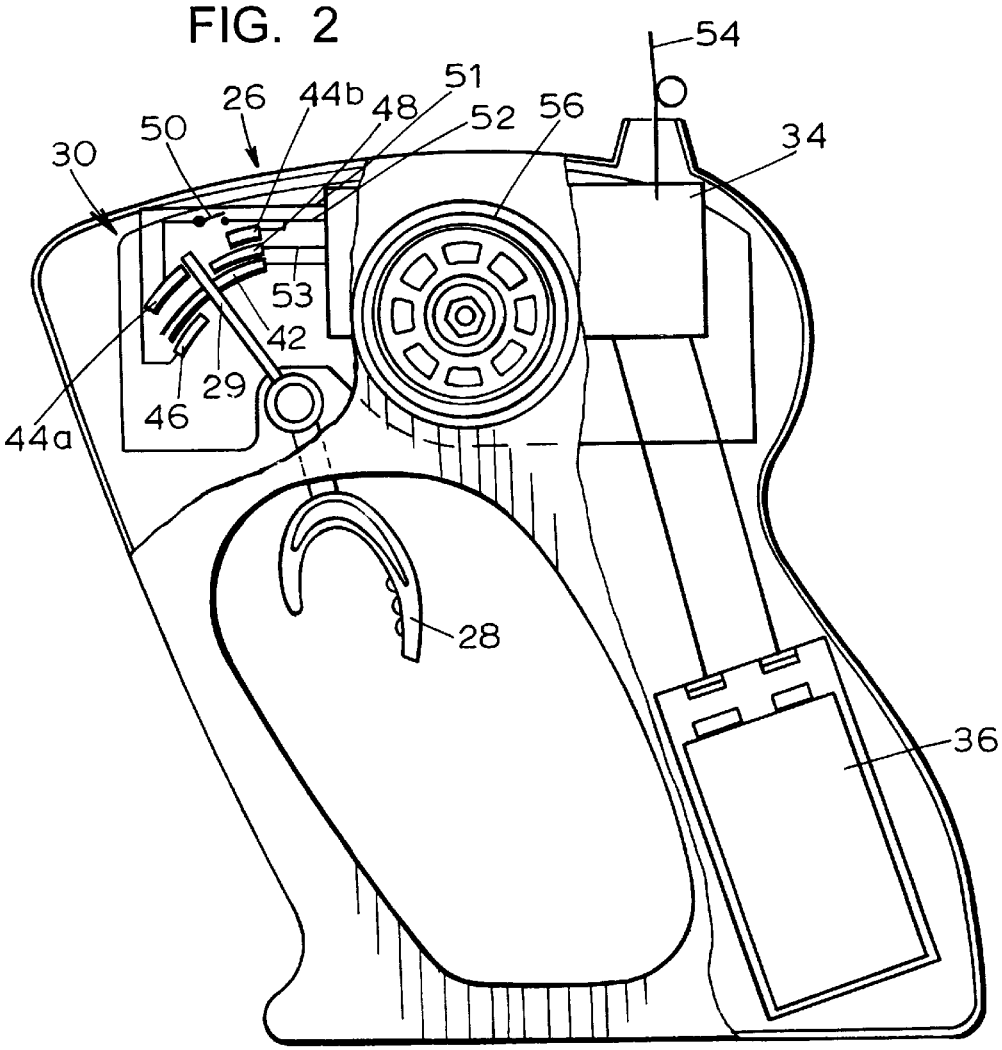
FIG. 2 is a partial cut-away view of a transmitter unit used with the toy vehicle of the present invention.

FIG. 2 illustrates the hand-held transmitter unit 26 used to control movement of the vehicle 10 of FIG. 1. The transmitter unit 26 includes a trigger 28 pivotally coupled to a brush mechanism having a wiper arm 29 disposed in contact with a position sensing device 30 which, in turn, is electrically coupled to a signal encoder/transmitter 34 mounted on a PC board. A battery 36 supplies power to the encoder/transmitter 34.

To control the speed of the toy vehicle 10 of FIG. 1, an operator may either pull or push on the trigger 28 to move the trigger 28 away from a center position illustrated in FIG. 2, which causes movement of the wiper arm 29 relative to a common electrode 42 and a series of position sensing electrodes 44*a*, 44*b*, 46, and 48, all of which are electrically connected or coupled to the encoder/transmitter 34. A turbo mode or expert/beginner switch 50, the operation of which will be described hereinafter, is electrically coupled between the position sensing electrodes 44*a* and 44*b*.

During movement of the trigger 28, the wiper arm 29 remains in constant contact with the common electrode 42, which is preferably connected to an electrical ground, and also comes into contact with zero, one, or two of the position sensing electrodes 44*a*, 44*b*, 46, and/or 48. When such contact is made, the electrodes 44*a*, 44*b*, 46, and/or 48 are electrically coupled to the common electrode 42 and are, therefore, grounded. Otherwise these contacts remain at an open high state. The ground or open high signals developed at the electrodes 44*a*, 44*b*, 46, and 48 are detected by the encoder/transmitter 34 via lines 51, 52, and/or 53. The signals on the lines 51, 52, and 53, in combination, comprise a digital request for one of the multiplicity of speed control states.

For example, when the trigger 28 is in the center position illustrated in FIG. 2, the wiper arm 29 does not contact any of the position sensing electrodes 44*a*, 44*b*, 46, or 48, which leaves each of the lines 51, 52, and 53 in an open high state indicating that no movement of the vehicle 10 is desired. However, when the trigger 28 is pulled slightly back (and the switch 50 is in the closed position), the wiper arm 29 contacts the electrode 44*a*, sending a ground signal via the line 52 to the encoder/transmitter 34 while the lines 51 and 53 remain in the open high state. This set of signals indicates that a minimum forward speed condition is being requested. As the trigger 28 is pulled further back, the wiper arm 29 contacts both of the electrodes 44*a* and 46, grounding the lines 51 and 52 while leaving the line 53 in the open high state. This set of signals indicates to the encoder/transmitter 34 that a medium forward speed condition is being requested. When the trigger 28 is pulled all the way back, the wiper arm 29 contacts only the position sensing electrode 46, grounding the line 51 and leaving the lines 52 and 53 in the open high state. This set of signals indicates that a maximum forward speed condition is being requested.

Likewise, when the trigger 28 is pushed forward from the center position illustrated in FIG. 2, the wiper arm 29 contacts only the position sensing electrode 48, grounding the line 53 and leaving the lines 51 and 52 in the open high state (indicating that a low reverse speed condition is being requested), or the wiper arm 29 contacts both the electrodes 48 and 44*b*, grounding the lines 52 and 53 while leaving the line 51 in the open high state (indicating that a medium reverse speed condition is being requested). As indicated above, the signal encoder/transmitter 34 detects the signals delivered from the contacts 44*a*, 44*b*, 46, and 48 via the lines 51, 52, and 53 as a digital signal specifying one of a set of six possible speed control states requested by a user (i.e., no motion, low forward speed, medium forward speed, full forward speed, low reverse speed and medium reverse speed).

In the embodiment illustrated in FIG. 2, when the turbo switch (or the expert/beginner switch) 50 is set to non-turbo or beginner mode, the electrode 44*a* is disconnected from the line 52 so that the line 52 stays high even when the wiper arm 29 comes into contact with the electrode 44*a*. This operation effectively eliminates the full forward throttle speed state by preventing the line 52 from being connected to ground when the trigger 28 is pulled back. As a result of this operation, the encoder/transmitter 34 recognizes the highest speed position as a lower speed state, such as a medium throttle speed state. The switch 50 thereby operates to allow an operator to disconnect or eliminate the use of one of the potential speed control states, e.g., the state associated with the highest speed. Of course the switch 50 and/or other switches could be connected in other manners to eliminate or allow the use of other speed positions if so desired.

While the trigger 28 and position sensing device 30 have been described herein as signaling six separate speed control states, it will be understood that the position sensing device 30 could be modified to include more or less electrodes to detect and signal more or less speed control states. Likewise, the electrodes of the position sensing device 30 could be connected in other ways to signal any desired number of speed control states. Of course, if more than seven speed control states are used, the encoder/transmitter 34 must receive a higher number of input signals (four or more) to identify a selected one of such a multiplicity of speed control states.

If desired, the transmitter unit 26 may also include a rotatable dial 56 having position sensors (not shown) coupled between the battery 36 and the encoder/transmitter 34. The dial 56 may be operated in any desired manner to send steering commands to the encoder/transmitter 34 which may encode and transmit these commands to the vehicle 10. However, because such a steering control mechanism is not necessary for implementation of the speed control system 16 of the present invention, the operation of such a steering control mechanism will not be described further herein.

Figure 3:
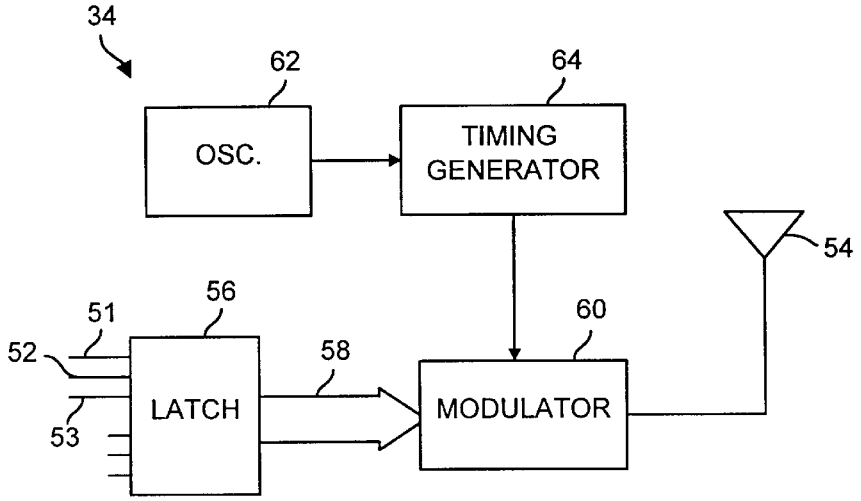
FIG. 3 is a block diagram of an encoder/transmitter located in the transmitter unit of FIG. 2.

The encoder/transmitter 34, illustrated in more detail in FIG. 3, encodes the information on the lines 51, 52, and 53 into, for example, three bits of a digital speed control signal, modulates the digital speed control signal onto a carrier and transmits the modulated carrier to the toy vehicle 10 of FIG. 1 via an antenna 54. As a result, the encoder/transmitter 34 operates as a digital signal transmitter. As illustrated in FIG. 3, the encoder/transmitter 34 includes a latch circuit 56 that latches the signals on the lines 51, 52, and 53, along with appropriate steering command signals, onto a digital bus 58 connected to a modulator 60. An oscillator 62 produces, for example, a 27.145 MHz, a 49.86 MHz, or any other desired stable frequency signal and delivers this signal to a standard timing generator 64, which provides appropriate timing signals to the modulator 60.

The modulator 60 uses the signals provided by the timing generator 64 to produce a serial digital control signal having serial bits corresponding to the digitally encoded speed control and steering control signals on the bus 58. This serial digital control signal, which may be of any desired length but, preferably is a byte in length, may also include clock bits and/or other information. The modulator 60 then modulates and amplifies the serial digital control signal using, for example, amplitude modulation (AM), to produce a modulated control signal. The modulator 60 then transmits the modulated digital control signal to the vehicle 10 via the antenna 54. If desired, the modulator 60 may periodically develop a sync, reset, or other signal (stored in a memory thereof) to be transmitted to the vehicle 10. Operation of the oscillator 62 and the timing generator 64 is well known and, therefore, will not be described further herein.

Figure 4:
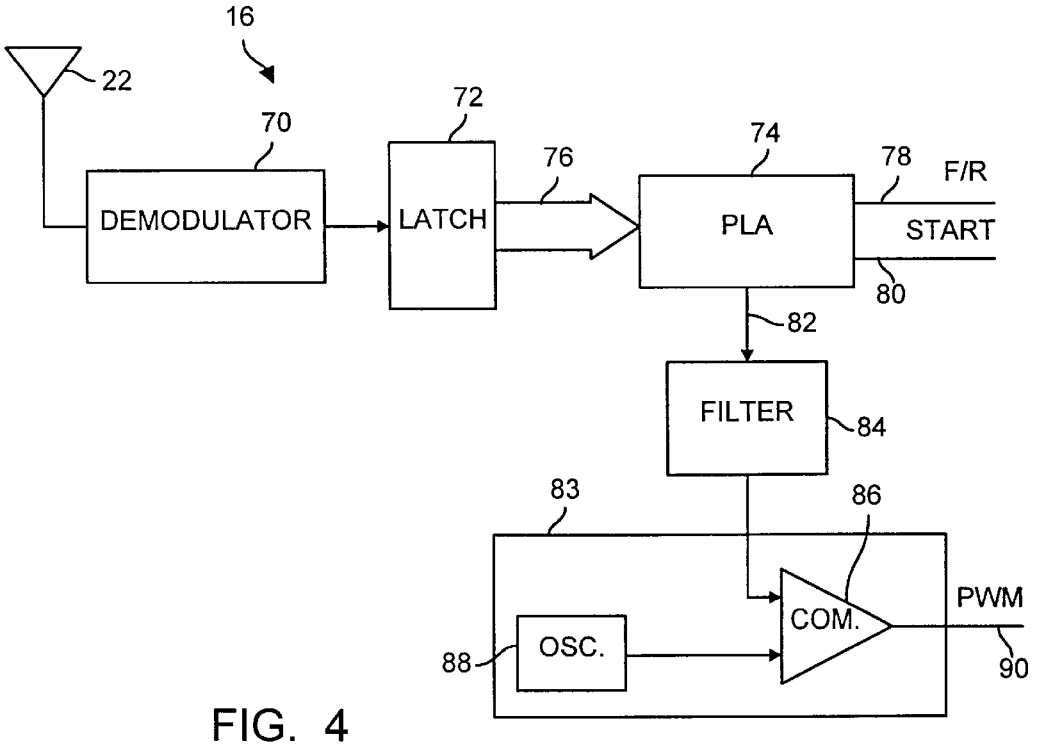
FIG. 4 is block diagram of a first portion of the speed control system according to the present invention.
Figure 5:
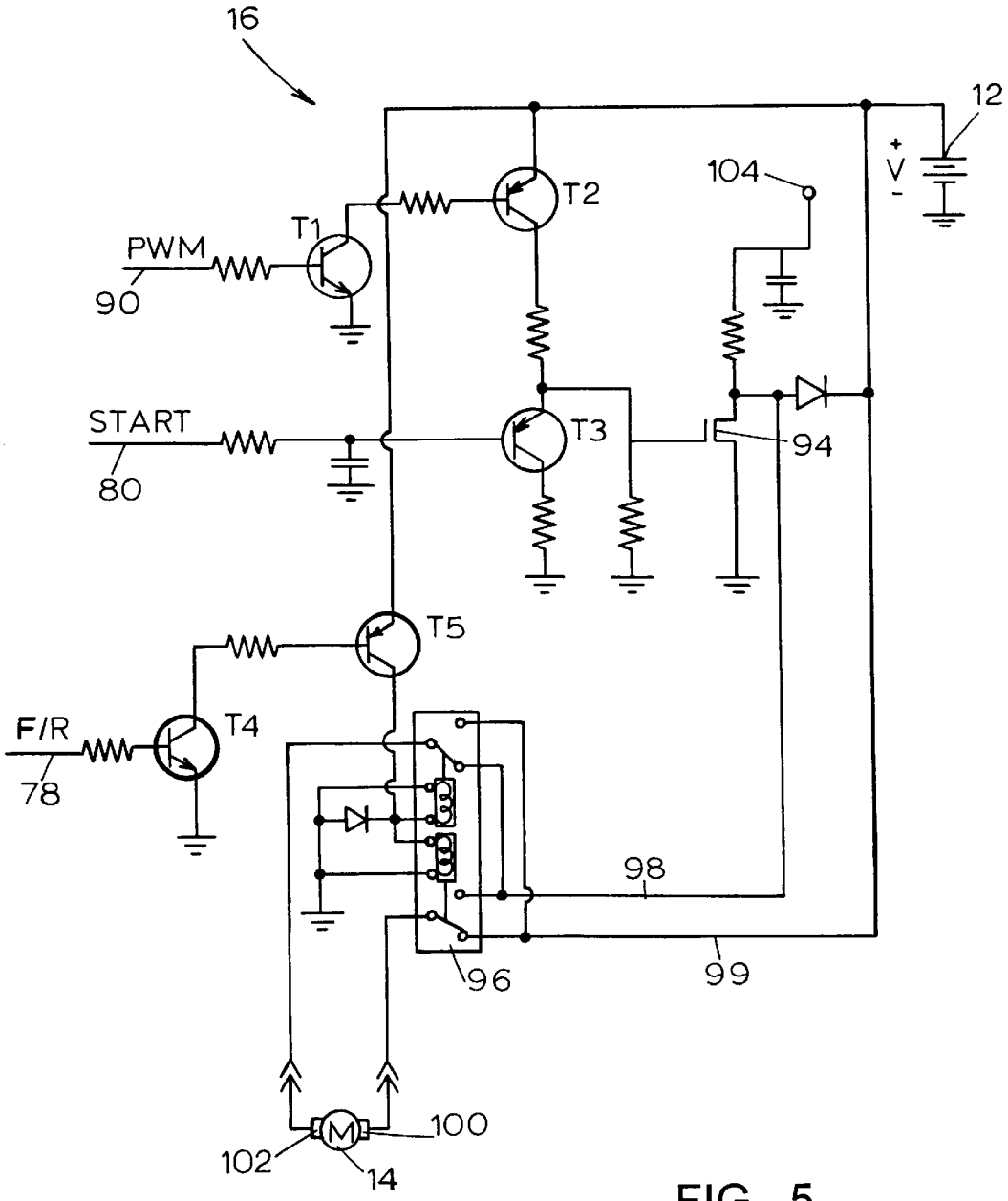
FIG. 5 is circuit schematic diagram of a second portion of the speed control system according to the present invention.

The speed control system 16 of FIG. 1 is illustrated in more detail in FIGS. 4 and 5. Referring to FIG. 4, the modulated digital control signal produced by the modulator 60 (FIG. 3) is received by a receiver including the antenna 22 and a demodulator 70, which may comprise any standard AM demodulator such as, for example, any known super-regenerative demodulator or, alternatively, any superheterodyne demodulator. The demodulator 70 demodulates the received control signal and produces a digital state signal comprising a serial, digitally encoded control signal having a number of the bits thereof specifying a requested one of the multiplicity of speed control states. A serial-to-parallel latch 72 samples the output of the demodulator 70 and delivers the digital state signal to a speed controller, illustrated as a programmable logic array (PLA) 74, via a digital bus 76. The PLA 74, which may include a microprocessor, hard-wired logic elements, and/or any other desired or known circuitry, decodes the bits of the digital state signal corresponding to the requested one of the speed control states and produces a forward/reverse (F/R) signal on a line 78, a START signal on a line 80, and a voltage signal on a line 82 in response to the requested speed control state.

Preferably, the PLA 74 produces a high F/R signal on the line 78 when a reverse speed control state is decoded and leaves the F/R signal on the line 78 low when a forward or stop speed control state is decoded. The PLA 74 produces a high START signal on the line 80 when the PLA 74 actively detects and decodes a non-zero speed request.

The voltage signal on the line 82, which may vary between any of a number of discrete levels, is delivered to a PWM signal generator 83 which produces a PWM signal having a duty cycle corresponding to one of the requested speed control states. The voltage signal on the line 82 may be provided through a low pass filter 84 (such as a voltage choke or an L/C network) to a first input of a comparator 86. The output of a triangular wave or ramping oscillator 88 is connected to a second input of the comparator 86, which produces a constant amplitude PWM signal on a line 90 having a duty cycle corresponding to the voltage level delivered from the filter 84. In particular, whenever the voltage signal from the filter 84 is greater than the ramped voltage signal from the oscillator 88, the comparator 86 produces a high pulse on the line 90. As will be understood, the duty cycle of the PWM signal on the line 90 increases as the voltage signal from the PLA 74 increases.

Preferably, the levels of the voltage signal produced by the PLA 74 are set so that, when a 7.2 voltage source, such as a battery, is used with the system, the comparator 86 produces a PWM signal having a duty cycle of about 100 percent (constant on) in response to a full forward throttle speed control state, a PWM signal having a duty cycle of about 80 percent in response to a medium forward or maximum reverse throttle speed control state, and a PWM signal having a duty cycle of about 40 percent in response to a minimum forward throttle or a minimum reverse throttle speed control state. The 40 percent PWM duty cycle relates to approximately ⅓ of the full motor speed, the 80 percent PWM duty cycle relates to approximately ⅔ of the full motor speed and the 100 percent PWM duty cycle relates to maximum or full motor speed. If desired however, these or other PWM duty cycles could be associated with any number of speed control states in any other desired manner. Moreover, the PWM signal produced by the comparator 86 preferably has a peak voltage of approximately five volts and a frequency of approximately 200 Hz. However, other peak voltages and frequencies could be used instead.

The PLA 72 may also be designed to detect higher voltage sources, such as 9.6 volt batteries, and lower the voltage levels provided to the PWM signal generator 83 in response thereto. In such a case, the duty cycles of the PWM signal produced by the PWM signal generator 83 will be reduced from the values given above. However, because of the higher voltage power source, the PWM signal generated by the PWM signal generator 83 will operate to drive the motor 14 in a manner similar to the case in which 7.2 volt batteries are used. In such a configuration, the PLA 72 and the PWM signal generator 83 operate as a voltage regulator to control the speed of the motor 14 to be the same when different types of batteries are used.

The filter 84 is designed to prevent the voltage signal on the line 82 from switching between multiple (three or more) consecutive speed control states too quickly. The filter 84 is especially useful when, for example, the trigger 28 (FIG. 2) is pulled back to the full forward throttle position from a no speed condition in a very short period of time. In such a case, the filter 84 provides a controlled change in the requested speed control state over a predetermined period of time greater than the time in which the actual change in the speed control state was received. The effective time constant of the filter 84 may be chosen, for example, to provide a ¼ second delay between the time in which the voltage level at the output thereof changes between a no speed level (i.e., a zero percent PWM duty cycle) and the time in which the voltage level at the output thereof rises to a full throttle level (i.e., a 100 percent duty cycle). Of course, other delay times may be used as well.

As will be understood, the ramping voltage level produced by the filter 84 causes the comparator 86 to produce a PWM signal having a duty cycle that increases in a ramped manner, i.e., a ramped PWM duty cycle. Such a ramped PWM duty cycle signal reduces wear and tear on the motor 14 and on the gears of the drive mechanism within the vehicle 10, slightly reduces battery and motor heat and, thereby, slightly increases play time. It also makes the vehicle 10 easier to operate by reducing, for example, wheel spin in response to an initial high throttle input signal.

While the control system 16 has been described herein as using a PLA 74 and an analog PWM signal generator 83, it will be understood that other types of analog or digital circuits may be substituted therefor, including microprocessor circuits, standard digital PWM waveform generator circuits, etc. without departing from the invention.

Referring now to FIG. 5, a preferred circuit for implementing control of the motor 14 using the PWM, the START and the F/R signals developed by the PLA 74 and the PWM signal generator 83 is illustrated. Generally speaking, the PWM and START signals control the operation of a semiconductor switch, preferably comprising a MOSFET switch 94, to provide a PWM current signal from the battery 12 to the motor 14. The F/R signal controls the operation of a relay 96 that controls the direction of current flow through the motor 14. As illustrated in FIG. 5, the relay 96, which may comprise a double pole, double throw relay, includes two inputs and four outputs, wherein two of the outputs are associated with each of the two inputs. Preferably, pairs of the outputs are connected together at relay output lines 98 and 99 and these lines are coupled through the inputs of the relay 96 to different terminals of the motor 14, as illustrated in FIG. 5.

Upon receiving a speed control signal specifying a forward state, the PLA 74 produces a low voltage or off F/R signal which leaves the relay 96 configured as illustrated in FIG. 5. At that time, the comparator 86 produces a PWM signal having a specific duty cycle, for example, 40 percent or 80 percent, and delivers this PWM signal to the base of the n-type transistor T1. The high pulses of the PWM signal turn the transistor T1 on which, in turn, saturates the p-type transistor T2 thereby switching on the transistor T2. The START signal, which is set high whenever the PLA 74 produces non-zero duty-cycle PWM signals, turns on a transistor T3. When the transistors T2 and T3 conduct, current flows from the battery 12 to the gate of the MOSFET 94 which saturates the MOSFET 94 thereby turning on the MOSFET 94. At this time, a connection between the relay output line 98 and ground is established, thereby allowing current flow between the battery 12 and the motor 14. In particular, current flows from the battery 12, through the line 99, through the relay 96 into a first motor terminal 100, through the motor 14 to a second motor terminal 102, back through the relay 96 to the relay output line 98, and then through the MOSFET switch 94 to ground. Flow of current in this manner energizes and drives the motor 14 in the forward direction. When the PWM signal goes low, the transistors T1, T2 and the MOSFET switch 94 turn off which stops the flow of current through the motor 14. Of course, the higher the duty cycle of the PWM signal, the more current that flows through the motor 14, which causes the motor 14 to rotate at a higher speed.

When the PLA 74 decodes and identifies a reverse speed control state, it sets the F/R signal high which, in turn, switches on transistors T4 and T5. At this time, current flows from the battery 12 through the coils of the relay 96 to ground, causing both contacts of the relay 96 to switch. Switching of the relay contacts reverses the direction of current flow through the relay inputs which, in turn, reverses the direction of current flow through the motor 14 causing the motor 14 to rotate in the reverse direction. If desired, when the F/R signal goes high, the START signal can be held low for a short period of time so that the first high pulse of the PWM signal produced by the comparator 86 of FIG. 4 may be delayed slightly to prevent the MOSFET switch 94 from conducting while the relay 96 is switching. This operation prevents arcing within the relay 96 which extends the life of the relay 96. Also, if desired, a voltage source may be connected to a terminal 104 to prevent current from flowing through the MOSFET switch 94 when, for example, a temperature sensor device (not shown) detects that the temperature of the motor 14 is too high.

While a MOSFET switch 94 has been illustrated for use as a switch responsive to the PWM signal generated by the comparator 86, other switches, including other types of power semiconductor switches can be used as well. FET switches are considered to be preferable, however, because FET switches have only a very low voltage drop between the source and drain terminals thereof, which allows more current to flow through the motor 14. Likewise, although a double pole, double throw relay 96 has been illustrated herein for use in changing the direction of current flow through the motor 14, other types of relays or switches could be used instead.

Although the toy vehicle 10 described herein is illustrated as a car, it should be noted that this vehicle could be any other type of vehicle, including a truck, an airplane, a boat or any other remote-control vehicle having a motor that drives a drive mechanism in forward and reverse directions. Moreover, if desired, the turbo mode or expert/beginner switch 50 illustrated in FIG. 1 may be located on the toy vehicle 10 and the PLA 74 may determine if certain ones of the multiplicity of speed control states need to be locked out of use to, for example, eliminate the possibility of having a full throttle speed control state. Still further, the turbo mode or expert/beginner switch 50 could have multiple positions enabling or disabling further combinations of the multiplicity of speed control states.

While the present invention has been described with reference to specific examples, which are intended to be illustrative only and not to be limiting of the invention, it will be apparent to those of ordinary skill in the art that changes, additions, and/or deletions may be made to the disclosed embodiments without departing from the spirit and scope of the invention.

What is claimed is:

1. A speed control system adapted for use in a remote-control vehicle having a power source coupled to a motor and receiving a control signal, the speed control system comprising:

a receiver that receives the control signal and produces a digital state signal specifying one of a multiplicity of speed control states;

a speed controller responsive to the digital state signal that develops a forward/reverse signal and a pulse-width modulated speed signal based on the specified one of the multiplicity of speed control states, wherein the forward/reverse signal includes two states such that a first state corresponds to the forward direction of the motor and a second state corresponds to the reverse direction of the motor;

a switching network coupled between the power source and the motor that is responsive to the pulse-width modulated signal for delivering a power signal from the power source to the motor and that is responsive to the forward/reverse signal to control the direction of the motor.

2. The speed control system of claim 1, wherein the switching network includes a first switch comprising a MOSFET device responsive to the pulse-width modulated signal.

3. The speed control system of claim 1, wherein the switching network includes a first switch comprising a semiconductor switching device responsive to the pulse-width modulated signal.

4. The speed control system of claim 3, wherein the switching network includes a second switch comprising a relay responsive to the forward/reverse signal.

5. The speed control system of claim 3, wherein the second switch comprises a double-pole, double throw relay.

6. The speed control system of claim 1, wherein the receiver produces a digital state signal specifying one of at least six speed control states.

7. The speed control system of claim 6, wherein three of the six speed control states are forward states and two of the six speed control states are reverse states.

8. The speed control system of claim 7, wherein the speed controller develops an approximately 40 percent duty cycle pulse-width modulated signal for a first forward speed control state, an approximately 80 percent duty cycle pulse-width modulated signal for a second forward speed control state, and an approximately 100 percent duty cycle pulse-width modulated signal for a third forward speed control state.

9. The speed control system of claim 7, wherein the speed controller develops an approximately 40 percent duty cycle pulse-width modulated signal for a first reverse speed control state and an approximately 80 percent duty cycle pulse-width modulated signal for a second reverse speed control state.

10. The speed control system of claim 1, wherein the multiplicity of speed control states includes a plurality of consecutive speed control states, each having a pulse-width modulated duty cycle associated therewith, and wherein the speed control system includes means for producing a ramped duty cycle pulse-width modulated signal, having duty cycles changing between three or more of the pulse-width modulated duty cycles associated with the speed control states, over a first period of time in response to a change of state between two non-consecutive speed control states in a second period of time, wherein the second period of time is less than the first period of time.

11. The speed control system of claim 1, wherein the remote-control vehicle includes a controller device that is switchable between a multiplicity of positions, wherein each of the multiplicity of speed control states corresponds to one of the positions of the controller device and wherein the speed control system further includes a further switch that prevents the use of one of the speed control states when in a first position and that allows the use of the one of the speed control states when in a second position.

12. The speed control system of claim 11, wherein the further switch makes the one of the speed control states equal to another of the speed control states when in the first position.

13. The speed control system of claim 11, wherein the remote-control vehicle includes a transmitter module and wherein the further switch is located on the transmitter module.

14. The speed control system of claim 1, wherein the speed controller operates as a voltage regulator and, for the same digital state signal, produces PWM signals having different duty cycles when the speed control system is coupled to power sources of different voltages.

15. A remote-control vehicle system comprising:

a transmitter module including:

a speed position sensing device that detects one of a multiplicity of speed positions, and a digital signal transmitter coupled to the speed position sensing device to produce a digital control signal indicating one of a multiplicity of speed states corresponding to the detected one of the multiplicity of speed positions; and a vehicle module including;

a receiver that receives the digital control signal and produces a digital state signal specifying the one of a multiplicity of speed states;

a speed controller responsive to the digital state signal that develops a forward/reverse signal and a pulse-width modulated speed signal, wherein the forward/reverse signal includes two states that a first state corresponds to the forward direction of the motor and a second state corresponds to the reverse direction of the motor;

a first switch responsive to the pulse-width modulated signal for delivering a power signal to the motor; and a second switch coupled to the motor and responsive to the forward/reverse signal to control the direction of the motor.

16. The remote-control vehicle of claim 15, wherein the first switch comprises a MOSFET device.

17. The remote-control vehicle of claim 16, wherein the second switch comprises a relay.

18. The remote-control vehicle of claim 15, wherein each of the multiplicity of speed states has a pulse-width modulated duty cycle associated therewith, and wherein the speed controller includes means for producing a ramped duty cycle pulse-width modulated signal having duty cycles changing between three or more of the pulse-width modulated duty cycles associated with the speed states over a first period of time in response to a change of the speed position sensing device between two non-consecutive speed positions in a second period of time, wherein the second period of time is less than the first period of time.

19. The remote-control vehicle of claim 15, further including a third switch that prevents the use of one of the speed states when in a first position and that allows the use of the one of the speed states when in a second position.

20. A speed control circuit for use in a remote-control vehicle having a motor, a power source, and a receiver that receives a control signal, the speed control circuit comprising:

a speed controller that develops a forward/reverse signal and a pulse-width modulated speed signal from the received control signal, wherein the forward/reverse signal includes two states such that a first state corresponds to the forward direction of the motor and a second state corresponds to the reverse direction of the motor;

a semiconductor switch coupled between the power source and the motor and responsive to the pulse-width modulated speed signal for delivering a pulse-width modulated power signal from the power source to the motor; and a relay coupled in series with the semiconductor switch that switches in response to the forward/reverse signal to control the direction of current flow through the motor.

21. The speed control circuit of claim 20, wherein the motor includes first and second motor terminals, wherein the relay comprises a dual input, quadruple output relay, and wherein two of the relay outputs are connected together and are coupled through one of the relay inputs to the first motor terminal and the other two of the relay outputs are connected together and are coupled through the other of the relay inputs to the second motor terminal.

22. The speed control circuit of claim 21, wherein the semiconductor switch is a field effect transistor device having a gate electrode coupled to receive the pulse-width modulated signal.

23. The speed control circuit of claim 20, wherein the control signal is a digital control signal, wherein the speed control circuit further includes a signal decoder that decodes the digital control signal to identify one of a multiplicity of control states, and wherein the speed controller develops the forward/reverse signal and the pulse-width modulated speed signal based on the identified one of the multiplicity of control states.

* * * * *